US008991604B2

(12) United States Patent
Buckley

(10) Patent No.: US 8,991,604 B2
(45) Date of Patent: Mar. 31, 2015

(54) EGG PACKAGE

(75) Inventor: Nick Buckley, Watford Hertfordshire (GB)

(73) Assignee: Brødrene Hartmann A/S, Gentofte (DK)

( * ) Notice: Subject to any disclaimer, the term of this patent is extended or adjusted under 35 U.S.C. 154(b) by 0 days.

(21) Appl. No.: 14/000,534

(22) PCT Filed: Jan. 11, 2012

(86) PCT No.: PCT/IB2012/050136

§ 371 (c)(1),
(2), (4) Date: Sep. 20, 2013

(87) PCT Pub. No.: WO2012/114206

PCT Pub. Date: Aug. 30, 2012

(65) Prior Publication Data

US 2014/0042169 A1 Feb. 13, 2014

(30) Foreign Application Priority Data

Feb. 22, 2011 (EP) ..... 11155411

(51) Int. Cl.
*B65D 85/32* (2006.01)

(52) U.S. Cl.
CPC ..... *B65D 85/32* (2013.01); *B65D 85/324* (2013.01); *B65D 2203/02* (2013.01)
USPC ..... 206/521.1

(58) Field of Classification Search
USPC ..... 206/521.1, 521.8, 1.5; 220/508
See application file for complete search history.

(56) References Cited

U.S. PATENT DOCUMENTS

| | | | | | |
|---|---|---|---|---|---|
| 3,570,747 | A | * | 3/1971 | McKenna et al. | 206/521.1 |
| 3,647,132 | A | * | 3/1972 | Crabtree | 229/406 |
| 3,648,916 | A | * | 3/1972 | Commisso | 206/521.8 |
| 3,712,532 | A | * | 1/1973 | Alroy | 206/521.1 |
| 3,735,917 | A | * | 5/1973 | Warburton | 206/521.1 |
| 4,240,575 | A | * | 12/1980 | Tange | 206/521.1 |
| 4,280,648 | A | * | 7/1981 | Boursier | 206/521.1 |
| 4,298,156 | A | * | 11/1981 | Reifers et al. | 206/521.1 |
| 4,383,638 | A | * | 5/1983 | Bixler | 220/4.23 |

(Continued)

FOREIGN PATENT DOCUMENTS

WO WO 2008/085037 A1 7/2008

OTHER PUBLICATIONS

International Search Report for. PCT/IB2012/050136 dated Apr. 11, 2012.

(Continued)

*Primary Examiner* — Steven A. Reynolds
(74) *Attorney, Agent, or Firm* — Marvin Petry; Stites & Harbison PLLC

(57) ABSTRACT

An egg package formed of a fibrous material includes a bottom part which has egg receiving compartments which at least partially match the outer contours of an egg. A cover part has a top surface, a front surface, a back surface and two end surfaces. The Front side has a generally horizontal upper edge with restraint projections extending forwardly and downwardly from the upper edge for locking engagement with cooperating apertures in the front surface of the cover part. The front surface of the cover adjacent to the bottom part has apertures. The cover part has a plurality of longitudinal recesses extending between the top surface and the front surface of the cover part through each recess and extends from the top surface down beyond the middle of the front surface.

7 Claims, 6 Drawing Sheets

(56) References Cited

U.S. PATENT DOCUMENTS

| | | | | |
|---|---|---|---|---|
| 4,650,076 | A * | 3/1987 | Padovani | 206/526 |
| 4,715,529 | A * | 12/1987 | Bixler | 206/521.1 |
| 4,782,995 | A | 11/1988 | Emery et al. | |
| 5,102,034 | A * | 4/1992 | Amabili | 206/521.1 |
| 5,282,534 | A * | 2/1994 | Lapp | 206/232 |
| 5,860,528 | A | 1/1999 | Emery | |
| 6,488,152 | B1 | 12/2002 | Steffann | |
| 2005/0238764 | A1 * | 10/2005 | Beese | 426/106 |
| 2006/0060493 | A1 * | 3/2006 | Marshall | 206/521.1 |
| 2007/0017845 | A1 * | 1/2007 | Tietschert | 206/521.1 |
| 2013/0264243 | A1 * | 10/2013 | Aardema et al. | 206/521.1 |

OTHER PUBLICATIONS

Written Opinion of the International Searching Authority PCT/IB2012/050136, dated Apr. 11, 2012.

International Preliminary Report on Patentability for PCT/IB2012/050136 dated May 14, 2013.

* cited by examiner

EGG PACKAGE

TECHNICAL FIELD

The present invention pertains to an egg package of the kind set forth in the preamble of claim 1.

BACKGROUND OF THE INVENTION

Packages of the above kind, i.e. egg packages formed of a fibrous material are known in within the art. Among these a large number of different packages have been described. Such packages generally comprise a bottom part with a plurality of egg-receiving compartments. The plurality of egg receiving compartments is usually arranged in at least two parallel rows. The bottom part is often hingedly connected to a cover part so as to allow the cover part to move between an open position and a closed position. The cover part usually comprises a top surface, a front surface, a back surface, and two end surfaces.

Most such egg packages are furthermore provided with retainment means for releasably retaining the cover part in its closed position on the bottom part and a large number of different retainment means for this purpose has been described. For example the documents U.S. Pat. Nos. 4,782,995, 5,860,528, EP 1 098 826 and EP 1 995 185 describes various retainment means for egg packages.

U.S. Pat. No. 4,280,648 discloses an egg package of paper pulp having a pocketed section mutually hinged to a flat bottom cover section, both said sections comprising tapered walls bordering on said hinge, the external surfaces of said tapered walls bordering on said hinge comprising abutting elements projecting abutting elements cooperating together to limit the inverted folding around said hinge. The egg packages may be stacked in their flat open condition with the bottoms of the cover sections of a number of stacked containers maintained parallel thus allowing easy unstacking by mechanical devices such as suction-cups equipped unstackers. The pocket section is provided with upwardly extending retainment projections, each having an outwardly extending retainment projection for locking engagement with corresponding apertures in the cover part.

Similarly, US 2005/0238764 discloses an egg package having a bottom part with a plurality of egg receiving compartments, said bottom part being hinged to a cover part.

The bottom part is provided with upwardly extending retainment projections, each having an outwardly and downwardly extending retainment projection for locking engagement with corresponding apertures in the front side of the cover part.

However, it may be a problem with the known egg packages that their retainment means require the use of a bottom flap, i.e. a flap extending from the bottom part and which comprises locking means that are adapted to cooperate with corresponding locking means on the cover part, and possibly also a high rear hinge connecting the bottom part and the cover part, as illustrated in for example EP 1 098 826, in order to provide a sufficiently reliable closing and locking mechanism.

SUMMARY OF THE INVENTION

It is thus an object of the present invention to provide an egg package, which may be reliably closed and locked in a substantially error free manner by a machine, without having a bottom flap or a high rear hinge.

According to the present invention, the above-mentioned and other objects are fulfilled by an egg package formed of a fibrous material, the egg package comprising the following main parts:

- a bottom part comprising a plurality of egg-receiving compartments having non-planar side surfaces so as to match at least partially the outer contours of an egg, the plurality of compartments being arranged in at least two parallel rows and comprising at least one upwardly extending projection located between the rows of compartments,
- a cover part comprising a top surface, a front surface, a back surface, and two end surfaces,
- the cover part being connected to the bottom part by a hinge between the back surface and the bottom part so as to allow the cover part to move between an open position and a closed position,
- bottom part comprising a back side, a front side, two end sides, and at least one, preferably two to four, upwardly extending retainment projection extending from the front side of the bottom part, the upwardly extending retainment projection having a downwardly and outwardly extending retainment flap for locking engagement with co-operating locking means provided on the cover part. This retainment flap is very small in that it, preferably, has an extension that is no longer than the thickness of the material of the cover part of the egg package, for example an extension of 2 mm-3 mm.

Hereby is ensured a reliable and stable locking function that may be facilitated by simple mechanical closing means for example provided by packing machinery without the risk of damaging the fragile eggs that are placed in the package. This is due to the fact that the egg package according to the above embodiment may be closed and locked in one operation by pivoting the cover part in relation to the hinge. This pivoting of the cover part may thus be facilitated by only one mechanical operation by the packing machinery. Typically, packaging machinery is adapted for handling a tremendous number of packages over a short time span. It is therefore an important advantage of the present embodiment that the package can be closed and locked in an error free and reliable manner by the packaging machinery. Since, the retainment flap(s) are projecting downwardly and outwardly, the cooperating locking means on the cover part can slide over the retainment flap(s) during closing of the egg package and engage it in a locking manner, because the retainment flap(s) will simply work as a hook.

The cooperating locking means on the cover part is at least one aperture(s) in the front surface of the cover part. This way a simple—yet effective way—of providing reliable locking means on the cover part is achieved, which furthermore is easy to manufacture. Preferably, there is a number of such apertures that corresponds to the number of retainment flaps.

The apertures in the cover part are preferably framed in such a way that an edge is formed around and adjacent to each of the apertures. This edge will strengthen the boundary of said apertures and therefore enhance the reliability of the locking mechanism of the egg package. The edge (or frame) could for example be formed in such a way that an area around and adjacent to each of the apertures is inwardly or outwardly projecting.

According to a preferred embodiment the front surface adjacent to the lower part of each of the apertures is inwardly projecting, in order to provide a better locking engagement with the outwardly and downwardly extending retainment flaps that are situated on the retainment projections on the bottom part.

In order to enhance the locking engagement between the retainment flaps and the corresponding cooperating apertures in the cover part, the egg package may according to a preferred embodiment be so constructed that the lower part of the front surface of the cover part bulges inwardly. Such an inwardly bulging lower part of the front surface of the cover part will—due to the slight resilience of the pulp material—slide over the upwardly extending retainment projections which will force the front surface to bulge outwardly in such a manner that it will slide over these projections in an abutting manner until the apertures in the cover part will slide over the retainment flaps, and therefore provide a more reliable locking engagement between the cover part and the bottom part.

The front side of the cover part may comprise an inwardly projecting region above and adjacent to each aperture, said inwardly projecting region being adapted for engaging the top of the upwardly extending retainment projection. Hereby is achieved that the cooperation of the retainment projections and "inwardly projecting region" may work as a stopping mechanism that will preclude that the cover part—during the automatic closing and locking—will be forced down over the fragile eggs that otherwise may break during such an automated operation. This will also increase the load strength in the general stacking situation during distribution and when displayed on retailer shelves.

In a preferred embodiment the cover part may comprise a rim portion extending outwardly from the cover part. This rim portion may function as a gripping area for automated denesting machinery that is used in most egg packaging facilities.

Preferably, the top surface and the front surface of the cover part form an obtuse angle relative to each other, wherein the transition between the top surface and front surface is formed as a rounded transition region in such a way that there is a gradual—substantially edgeless—transition between the top surface and front surface, whereby it is more easy for a user to open the egg package and at the same time eases the automated closing of the package by packaging machinery. Furthermore, the rounded transitions facilitates a cleaner manufacturing of the closing features of the cover part, e.g. the apertures in the cover part, due to the larger release-angles than is possible for more "box-like" egg packages.

According to an embodiment the top surface and the back surface of the cover part form a substantially right or obtuse angle relative to each other, wherein the transition between the top surface and back surface is formed as a rounded transition region in such a way that there is a gradual—substantially edgeless—transition between the top surface and back surface.

According to one embodiment the curvature of the rounded transition between the top surface of the cover part and the back surface is substantially the same as the curvature of the rounded transition between the top surface and the front surface of the cover part.

By using rounded transitions between the top surface and back surface of the cover part, and by using rounded transitions between the top surface and front surface of the cover part it is contemplated that up to 10% less pulp material is needed for the cover of the egg package according to an embodiment of the invention as compared to more "box-like" or squarer egg packages.

In order to support the shape of the cover part, it comprises a plurality of longitudinal recesses extending between the top surface and the front surface of the cover part through the rounded transition region between the top surface and front surface. Hereby the shape of the transition between the top surface and front surface is reinforced (and maintained during use), because these recesses will impart to the cover part a sufficient rigidity that will counteract the relatively softness of the pulp material.

Similarly, the wherein the cover part comprises a plurality of longitudinal recesses placed in the rounded transition region between the top surface and front surface, and extending between the top surface and into the rounded transition region between the top surface and back surface of the cover part.

Moreover, these recesses counteract bowing of the lid and do therefore also enhance the effectiveness and reliability of the closure of the egg package as well.

In most countries there is a legal requirement that egg packages are provided with technical information about the eggs, such as farming conditions, origin, nutritional information, etc. Thus, according to a preferred embodiment the inner side of the top surface of the cover part comprises a substantially flat, and preferably also rectangular, info area onto which technical detail about the eggs is provided. Hereby it is achieved that such technical information is not directly visible from outside a closed egg package, and that such information therefore cannot interfere with the label and brand that the producer wants to convey to the consumer.

According to an embodiment of the invention the top and front, and preferably also the back, surfaces of the cover part are provided with a label that at least covers the apertures in the front surface.

According to an embodiment of the invention the top and front, and preferably also the back, surfaces of the cover part are provided with a label that at least covers the longitudinal recesses.

Hereby is provided an egg package wherein the label covers a very large area, and therefore facilitates ample opportunities for providing graphical and pictorial information.

According to a preferred embodiment of the invention the top and front, and preferably also the back, surfaces of the cover part are provided with a label that at least covers the longitudinal recesses and the apertures in the front surface of the cover part. By providing a label that covers the apertures and recesses, a better and substantially error free running in the packing station is achieved. Moreover, an egg package is provided, wherein none of the mechanical features of the egg package are visible from outside the egg package when it is closed. Such an egg package will therefore also have a more appealing look when placed in for example a sales rack on display in a store and when at home.

According to a preferred embodiment of the invention, at least one of the end surfaces of the cover part comprises a customized element.

Hereby is achieved an egg package that can be individualized to the needs of a particular costumer, e.g. producer, retailer, supermarket, packaging company, etc. By placing the customized part on the end surfaces there will still be room for the more traditional labels on the major part of the cover. Moreover, even when the egg filled egg packages are stacked in a sales rack, the end surfaces of the cover part will often be at least in part visible. Therefore, any provider of eggs will be able to distinguish their egg packages, over the other egg packages in a sales rack or a number of sales racks, to the largest extent by having an egg package, wherein at least one, but preferably both, of the end surfaces comprise a customized part.

Preferably, the at least one end surface of the cover part is divided into at least two sections, at least one of which being a customized element. Since the end surfaces of the cover part may be visible even when the egg packages are stacked in a sales rack, a division of the end surfaces will make them and thereby the egg packages with them more easily distinguishable and thereby enhances the visibility of them.

According to a preferred embodiment, the division of the at least one end surface of the cover part into at least two sections follows a, preferably smooth, division line that is formed as a recess or projection. Such a division line will strengthen and stabilize the cover.

In a preferred embodiment the top and front surfaces are adapted for being equipped with a label.

According to a preferred embodiment the egg package is formed by suction moulding of a fibrous material, such as moulded pulp, although other materials of suitable resilience and strength could be used.

In a preferred embodiment the at least two sections have different surface structure. For example at least one of the at least two sections may have a surface structure that is relatively coarse as compared to the relatively smooth surface structure of the remaining surface of the egg package.

In alternative embodiment at least one of the at least two sections has a surface structure that is relatively smooth as compared to the relatively coarse surface structure of the remaining surface of the egg package.

Preferably, at least one of the at least two sections is provided with an embossment and/or pattern and/or a printed region.

The division of the at least one end surface into at least two sections follows a distinct, preferably organic, form such as for example at least in part a ying-yang form. This will give the egg package a more pleasant appearance. The division line will in this case follow a smooth curve that divides the two major parts of a ying-yang form, and therefore give an increased strength and stability to the end surface of the cover of the egg package.

In a preferred embodiment, the embossment is formed as a seal and/or comprises touch typing. The embossment could for example be used to convey information as to whether the eggs, of the egg package itself is biodynamically produced, seal and logo of the producer, or any other suitable information. The embossment could also be formed as a substantially flat depression. This depression could for example be circular.

In order to enhance the visibility of an egg package according to the invention when it is placed in a sales rack, the customized part may at least in part comprise a colored section having one or more colors that are different than the color of the rest of the egg package. This could be achieved by coloring, e.g. printing, the particular section(s), or by using a fibrous material, e.g. pulp, having the desired color.

Mostly, the bottom part and cover part are being so constructed that the inner and outer surfaces of the bottom part as well as the inner surfaces and outer surfaces of the cover part are complementary, so when the egg package is fully open it may be nested with other, identical egg packages for shipment and/or storage. Usually, the egg packages are formed in such a way, that one fully open egg package fits within the egg package immediately preceding it in a stack. This kind of stacking of egg packages is a very compact way of stacking them together, and it is this way of stacking them together that is usually referred to as nesting.

Preferably, the egg package is moulded as one piece. This allows for a simple and efficient way of providing the above mentioned hinge connecting the bottom part and the cover part, namely by a weakening in the moulded material of the egg package.

Advantageously, the bottom part may comprise a rim portion extending outward from the bottom part.

The cover of an egg package of the above mentioned kind, i.e. one that is made of a fibrous material, is usually too soft to support layers of additional egg packages, filled with eggs, on top of each other, for example in a sales rack. Without the at least one upwardly extending projection located between the rows of compartments to support the cover when the egg package is closed, the weight of the additional egg filled egg packages will rest on the eggs of the lower packages in the stack, which then may break during storage and transport. Thus, according a preferred embodiment of the invention the inner side of the top surface of the cover part rests on the top of the upwardly extending projections of the bottom part when the cover part is in the closed position.

BRIEF DESCRIPTION OF THE DRAWINGS

A further understanding of the nature and advantages of the present invention may be realized by reference to the remaining portions of the specification and the drawings. In the following, preferred embodiments of the invention is explained in more detail with reference to the drawings, wherein.

DETAILED DESCRIPTION

Figure 1:
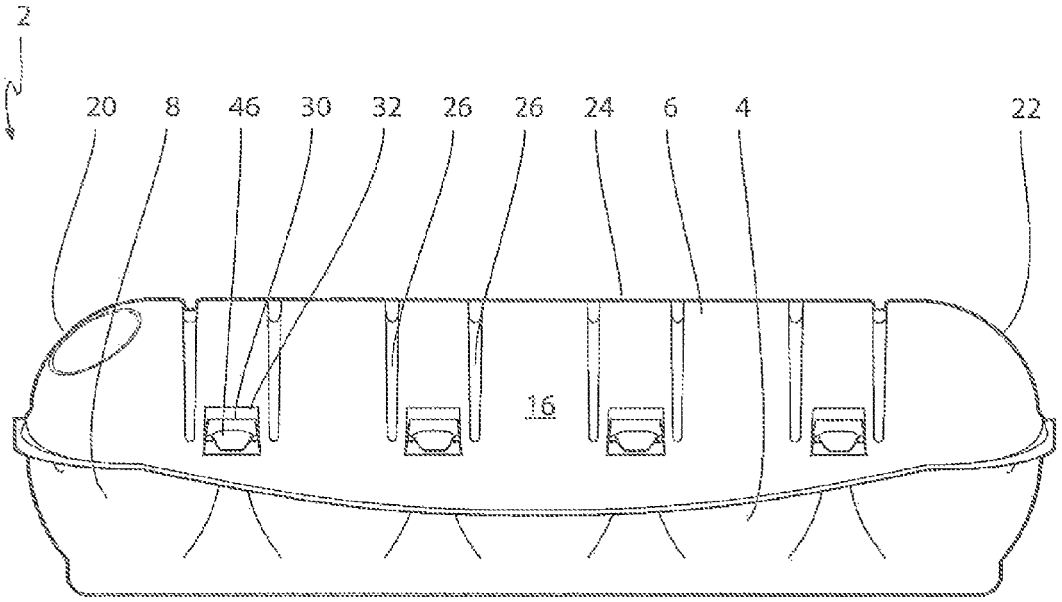
FIG. 1 shows a front view of an embodiment of an egg package according to the invention.

The present invention will now be described more fully hereinafter with reference to the accompanying drawings, in which exemplary embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout. Like elements will, thus, not be described in detail with respect to the description of each figure.

FIG. 1 shows an embodiment of an egg package 2 according to the invention with the cover part 6 in its closed position. The illustrated egg package 2 is preferably formed by suction moulding of a fibrous material, and the egg package 2 comprises a bottom part 4 and a cover part 6, wherein the bottom part 4 comprises a plurality of egg-receiving compartments 8 having non-planar side surfaces (not shown) so as to match at least partially the outer contours of an egg, the plurality of compartments 8 being arranged in at least two parallel rows and comprising at least one upwardly extending projection (not shown) located between the rows of compartments 8. In the illustrated front view of the egg package 2 the front surface 16 of the cover part 6 can be seen as well as a part of the two end surfaces 20, 22.

In order to support the shape of the cover part 6, it comprises a plurality of longitudinal recesses 26 extending between the top surface 24 and the front surface 16 of the cover part 6 through a rounded transition region between the top surface 24 and front surface 16. Hereby the shape of the transition between the top surface 24 and front surface 16 is reinforced and maintained during use, because these recesses 26 will impart to the cover part 6 a sufficient rigidity that will counteract the relative softness of the fibrous material.

In the illustrated embodiment there is a rounded—substantially edgeless—transition between the top surface 24 of the cover part 6 and the end surfaces 20 and 22.

Also seen in FIG. 1 are four apertures 30 in the front surface 16 of the cover part 6 that cooperates with corresponding retainment flaps 46 on the bottom part 4. The apertures 30 in the cover part 6 are framed in such a way that an edge 32 is formed around and adjacent to each of the apertures 30. This edge 32 will strengthen the boundary of said apertures 30 and therefore enhance the reliability of the locking mechanism of the egg package 2. The edge (or frame) 32 could for example be formed in such a way that an area around and adjacent to each of the apertures 30 is inwardly projecting.

Figure 2:
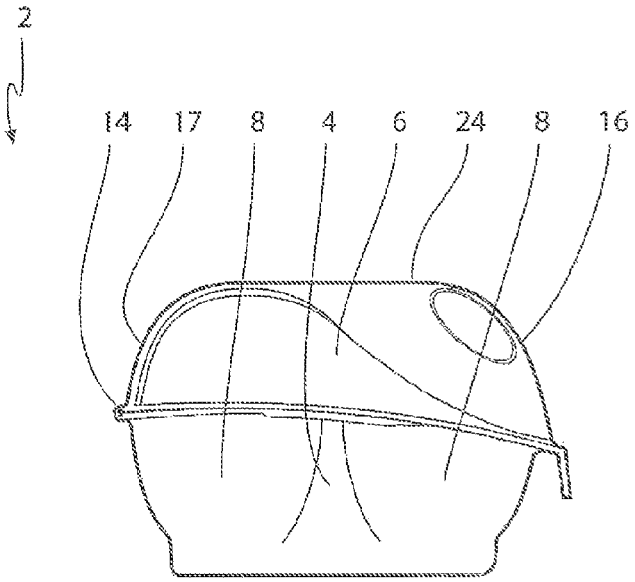
FIG. 2 shows an end view of an embodiment of an egg package according to the invention.

As can be seen more clearly in FIG. 2 the cover part 6 is connected to the bottom part 4 by a hinge 14 between the back surface 17 of the cover part 6 and the bottom part 4 so as to allow the cover part 6 to move between an open position and a closed position. The open position is illustrated more clearly in FIGS. 6, 7 and 10.

The top surface 24 and the front surface 16 of the cover part 6 form an obtuse angle relative to each other, wherein the transition between the top surface 24 and front surface 16 is formed as a rounded transition region in such a way that there is a gradual—substantially edgeless—transition between the top surface 24 and front surface 16, whereby it is more easy for a user to open the egg package 2 and at the same time eases the automated closing of the package 2 by packaging machinery. The rounded transitions also improve how the pack feels in the hand.

Furthermore, these rounded transitions facilitates a cleaner manufacturing of the closing features, especially the apertures 30, due to the larger releasing angle as compared to what is possible with more "box-like" egg packages 2.

The top surface 24 and the back surface 17 of the cover part 6 form a substantially right or obtuse angle relative to each other, wherein the transition between the top surface 24 and back surface 17 is formed as a rounded transition region in such a way that there is a gradual—substantially edgeless—transition between the top surface 24 and back surface 17.

By using rounded transitions between the top surface 24 and back surface 17 of the cover part 6, and by using rounded transitions between the top surface 24 and front surface 16 of the cover part 6 it is contemplated that up to 10% less pulp material is needed for the cover of the egg package 2 according to the illustrated embodiment of the invention as compared to more "box-like" egg packages.

Figure 3:
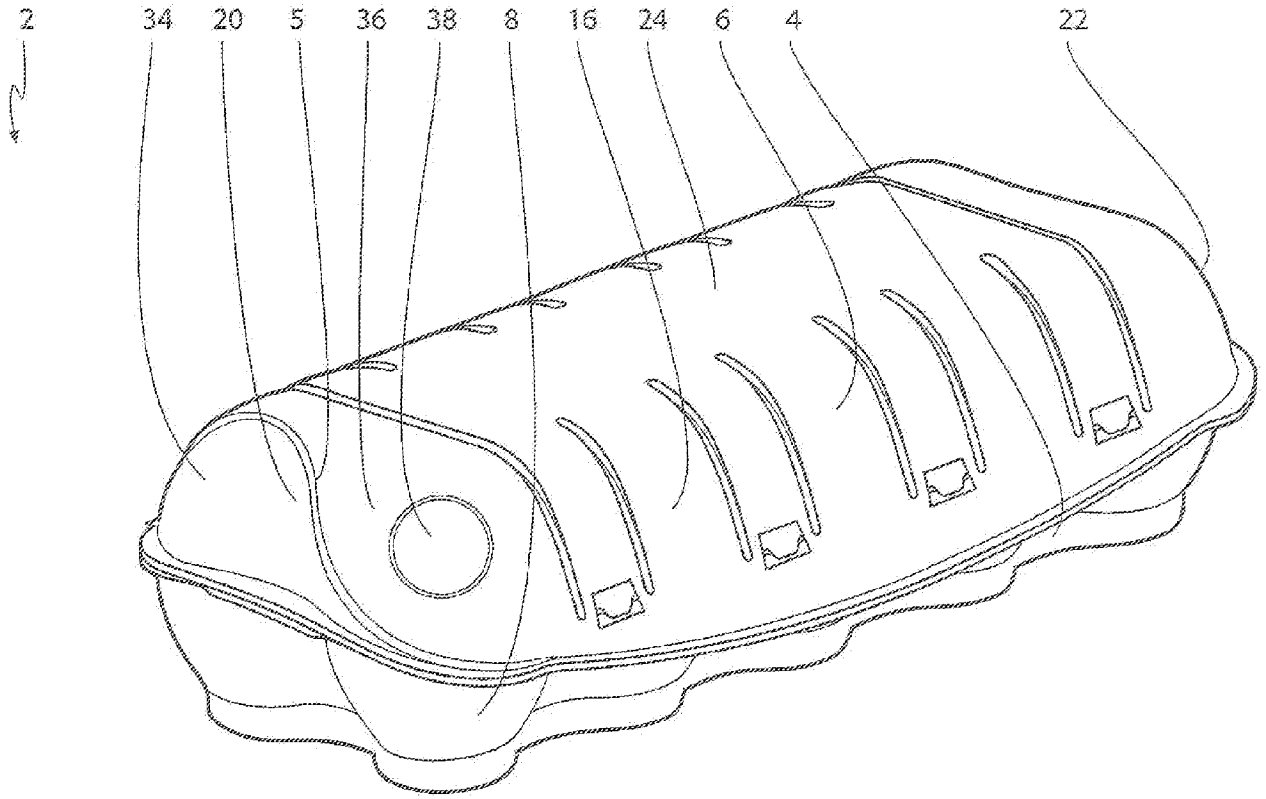
FIG. 3 shows a perspective view of an embodiment of an egg package according to the invention.

In FIG. 3 is illustrated a perspective view of the egg package 2 that is illustrated in FIGS. 1 and 2, wherein the substantially flat top surface 24 of the cover part 6 is visible.

The illustrated end surface 20 of the cover part 6 is divided, along a division line 5, into at least two sections 34 and 36, at least one of which being a customized element. Since the end surfaces 20 and 22 of the cover part 6 may be visible even when the egg packages 2 are stacked in a sales rack, a division of the end surfaces 20, 22 will make them and thereby the egg packages 2 with them more easily distinguishable and thereby enhances the visibility of them. The division line 5 is preferably formed as a recess or a projection. This will give an enhanced stability and strength to the end surface of the cover part 6.

In the illustrated embodiment the two sections 34 and 36 have different surface structure. The section 36 has a surface structure that is relatively coarse as compared to the relatively smooth surface structure of the other section 34 (and remaining surface of the egg package 2).

In an alternative embodiment it could be the other way around, so that the section 36 could have a surface structure that is relatively smooth as compared to the surface structure of the remaining surface of the egg package 2. The section 36 is moreover provided with an embossment 38 and/or pattern.

As illustrated the division of the end surface 20 into at least two sections 34 and 36 follows a distinct, preferably organic, form such as for example at least in part a ying-yang form. This will give the egg package 2 a more pleasant appearance. However other shapes or forms of the end surfaces 20, 22 could be envisaged.

In a preferred embodiment, the embossment 38 is formed as a seal and/or comprises touch typing and/or graphic design elements. The embossment 38 could for example be used to convey information as to whether the eggs, or the egg package 2 itself is biodynamically produced, seal and logo of the producer, or any other suitable information.

In order to enhance the visibility of an egg package 2 according to the invention when it is placed in a sales rack, the customized part may at least in part comprise a colored section having one or more colors that are different from the color of the rest of the egg package 2.

Figure 4:
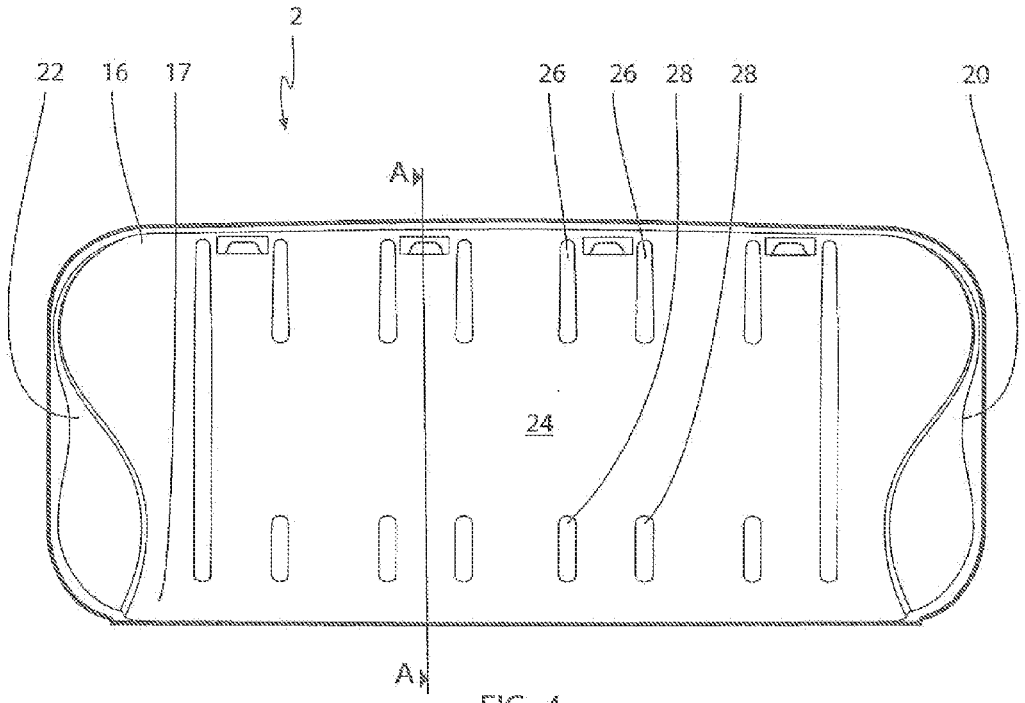
FIG. 4 shows an embodiment of an egg package according to the invention seen from above.

In FIG. 4 is illustrated a top view of the egg package 2. As can be seen the cover part 6 also comprises a plurality of longitudinal recesses 28 placed in the rounded transition region between the top surface 24 and back surface 17 and extending between the top surface 24 and into the rounded transition region between the top surface 24 and back surface 17 of the cover part 6. These recesses 28 also aid in strengthening the cover part 6. The recesses 26 and 28 are carefully placed between the pre-defined areas expected to be occupied by the eggs, so that it is precluded that they (26, 28) will interfere with the eggs during use of the egg package 2.

Figure 5:
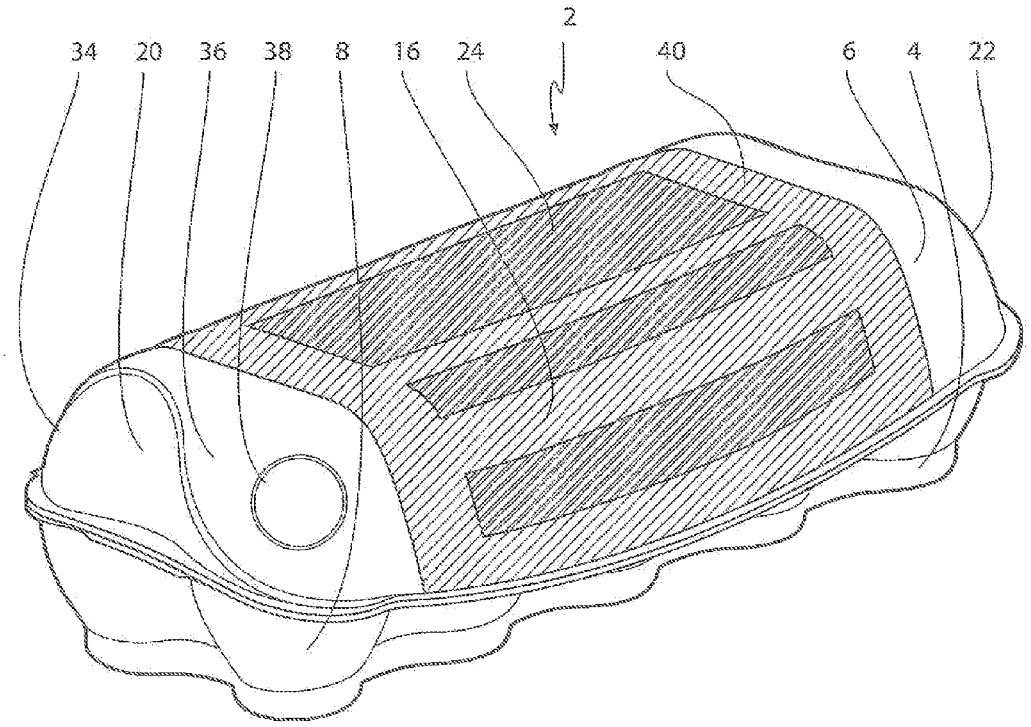
FIG. 5 shows a perspective view of an embodiment of an egg package according to the invention equipped with a label.

As illustrated in FIG. 5 the top surface 24 and front surface 16 of the egg package 2 are adapted for being equipped with a label 40. The label 40 preferably also covers the back surface 17 of the cover part 6. Hereby is achieved an egg package 2 wherein the recesses 26, 28, apertures 30 and retainment flaps 46 are not visible when the cover part 6 is in its closed position. The label 40 provides a large area for providing graphical and pictorial information. Furthermore, the rounded transition between the top surface 24 of the cover part 6 and the front surface 16 (and back surface 17 as well) gives an enhanced perception of the label as compared to egg packages having a more box-like cover part.

Figure 6:
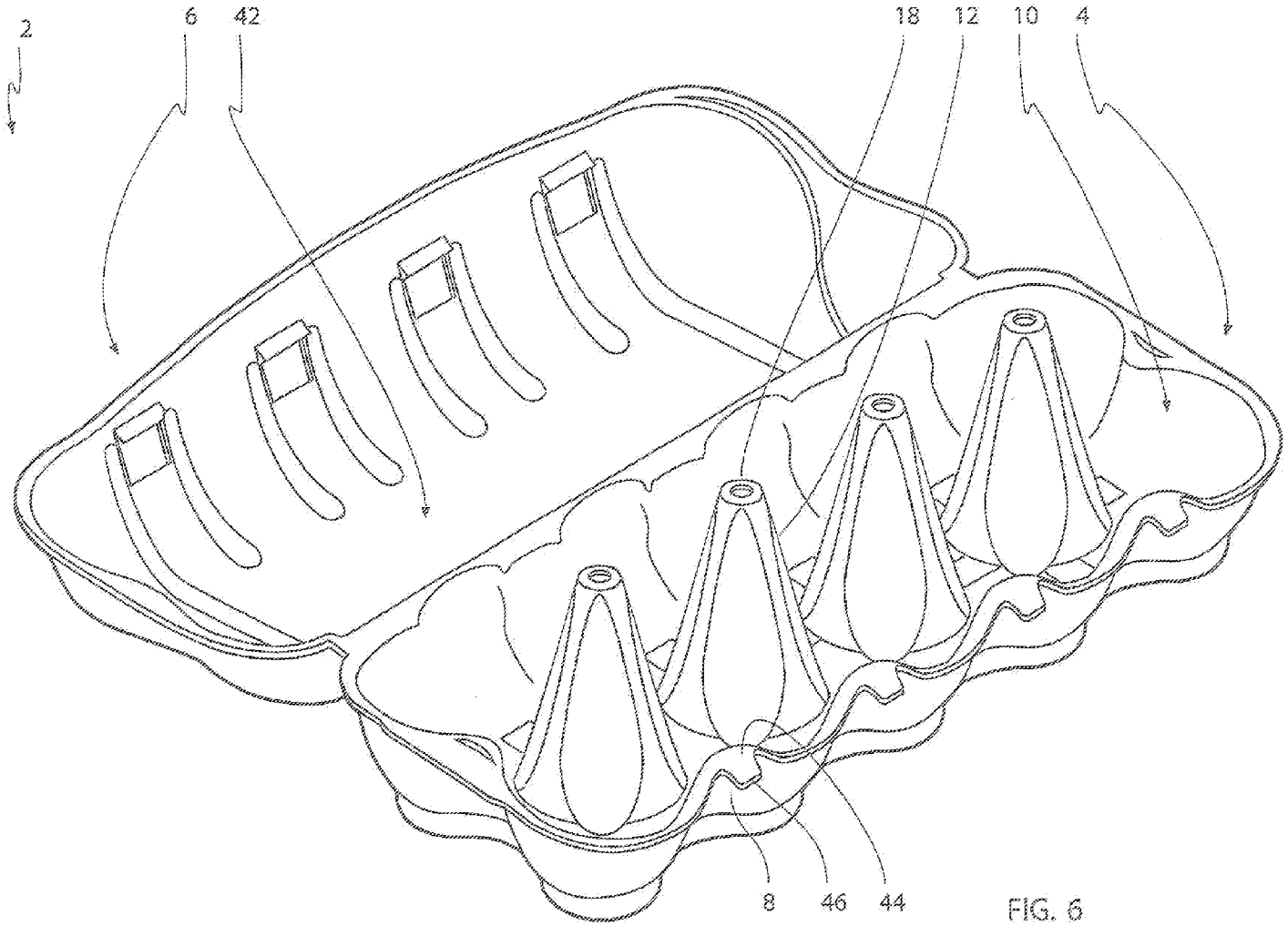
FIG. 6 shows a perspective view of an embodiment of an egg package according to the invention in its fully open position.

In FIG. 6 is illustrated a perspective view of the egg package 2 as described above in its fully open position. In this figure it can be seen more clearly that the bottom part 4 comprises a plurality of egg-receiving compartments 8 having non-planar side surfaces 10 so as to match at least partially the outer contours of an egg, and that the plurality of compartments 8 are arranged in two parallel rows with upwardly extending projections 12 located between the rows of compartments 8.

The cover part 6 of an egg package 2 of the above mentioned kind, i.e. one that is made by suction moulding of a fibrous material, is usually too soft to support layers of additional egg packages 2, filled with eggs, on top of each other, for example in a sales rack. Without the upwardly extending projections 12 located between the rows of compartments 8 to support the cover part 6 when the egg package 2 is closed, the weight of the additional egg filled egg packages 2 will rest on the eggs of the lower packages 2 in the stack, which then may break during storage and transport. Thus, according to a preferred embodiment of the invention, the inner side 42 of the top surface 24 of the cover part 6 rests on the top 18 of the upwardly extending projections 12 of the bottom part 4, when the cover part 6 is in the closed position. In the illustrated embodiment there are four upwardly extending projections 12, because it is an egg package for 10 eggs. However, for an egg package according to the invention that is made to accommodate only 4 eggs, there will only be one upwardly extending projection, and for a 6-pack, i.e. an egg package for only 6 eggs, there will be two upwardly extending projections 12.

Also illustrated are four upwardly extending retainment projections 44 each having a downwardly and outwardly extending retainment flap 46.

Figure 7:
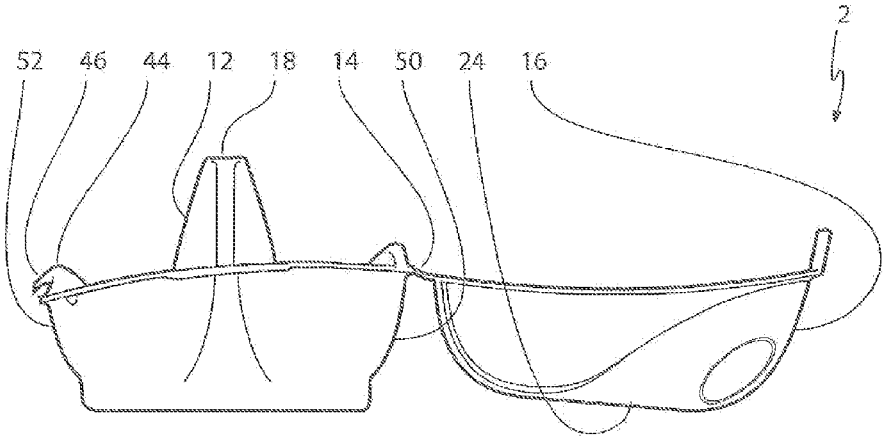
FIG. 7 shows an end view of an embodiment of an egg package according to the invention in its fully open position

FIG. 7 is an end view of the egg package 2 described above in its fully open position. In this illustration it is seen that the bottom part 4 comprises a back side 50, a front side 52. The (preferably four) upwardly extending retainment projections 44 are extending from the front side 52 of the bottom part 4, and each upwardly extending retainment projection 44 having a downwardly and outwardly extending retainment flap 46. The hinge 14 between the cover part 6 and the bottom part 4 may be formed as a weakening in the material of the egg package 2.

Figure 8:
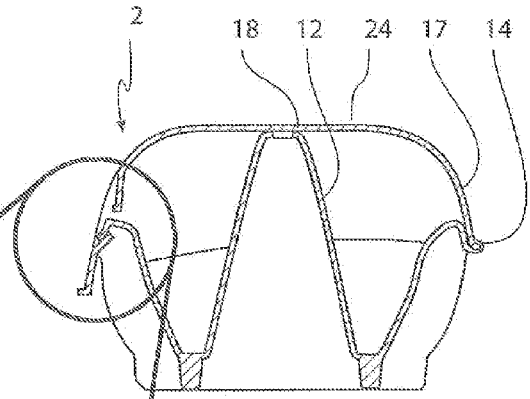
FIG. 8 shows cross section A-A of the egg package illustrated in FIG. 4.

FIG. 8 shows the cross section of the egg package 2 along the line A-A (see FIG. 4). The upwardly extending retainment projections 44 has a downwardly and outwardly extending retainment flap 46 for locking engagement with co-operating locking means provided on the cover part 6. This retainment flap 46 is very small and has an extension so that it does not penetrate the label 40 that is provided on the cover part 6 of the egg package 2. These cooperating locking means on the cover part is in the illustrated embodiment the apertures 30.

The front surface 16 adjacent to the lower part of each of the apertures 30 has an inwardly projecting frame part 54, in order to provide a better locking engagement with the outwardly and downwardly extending retainment flaps 46 that are situated on the retainment projections 44 on the bottom part 4.

Hereby is ensured a reliable and stable locking function that may be facilitated by simple mechanical closing means for example provided by packing machinery without the risk of damaging the fragile eggs that are placed in the package 2. This is due to the fact that the egg package 2 according to the above embodiment may be closed and locked in one operation by pivoting the cover part 6 in relation to the hinge 14. This pivoting of the cover part 6 may thus be facilitated by only one mechanical operation by the packing machinery. Typically, packaging machinery is adapted for handling a tremendous number of packages over a short time span. It is therefore an important advantage of the present embodiment that the package 2 can be closed and locked in an error free and reliable manner by the packaging machinery. Since the retainment flaps 46 are projecting downwardly and outwardly, the cooperating locking means on the cover part can slide over the retainment flaps 46 during closing of the egg package 2 and engage it in a locking manner, because the retainment flaps 46 will simply work as a hook.

Figure 9:
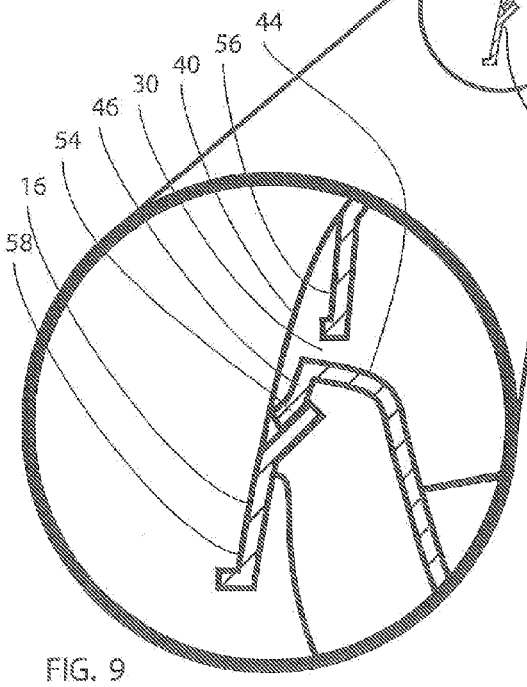
FIG. 9 shows a close up of a part of the cross section A-A.

FIG. 9 shows a close up view of a part of the cross section A-A of the locking mechanism of the egg package 2. As can be seen more clearly in this close up figure, there is a clearance between the upper part of the retainment projections 44 and the upper frame 56 of the aperture 30. This clearance allows the cover part 6 to sink low enough to let the inwardly projecting lower frame part 54 to slide over the retainment flap 46. The cover part 6 then relaxes back into the resting position after closing with the retainment flap 46 and inwardly projecting lover frame part 54 locked to each other.

When an end user wants to open the egg package 2 this can be done by a pulling the lower part 58 of the front surface 16 of the cover part 6 outwards away from the bottom part 4. This pulling will—due to the inherent resilience of the moulded fibrous material—result in a disengagement of the inwardly projecting lower frame part 54 and the retainment flaps 46.

In order to enhance the locking engagement between the retainment flaps 46 and the corresponding cooperating apertures 30 in the cover part 6, the egg package 2 may according to a preferred embodiment be so constructed that the lower part 58 of the front surface 16 of the cover part 6 bulges inwardly. Such an inwardly bulging lower part 58 of the front surface 16 of the cover part 6 will—due to the slight resilience of the moulded fibrous material—slide over the upwardly extending retainment projections 44 which will force the front surface 16 to bulge outwardly in such a manner that it will slide over these projections 44 in an abutting manner until the apertures 30 in the cover part 6 will slide over the retainment flaps 46, and therefore provide a more reliable locking engagement between the cover part 6 and the bottom part 4.

Figure 10:
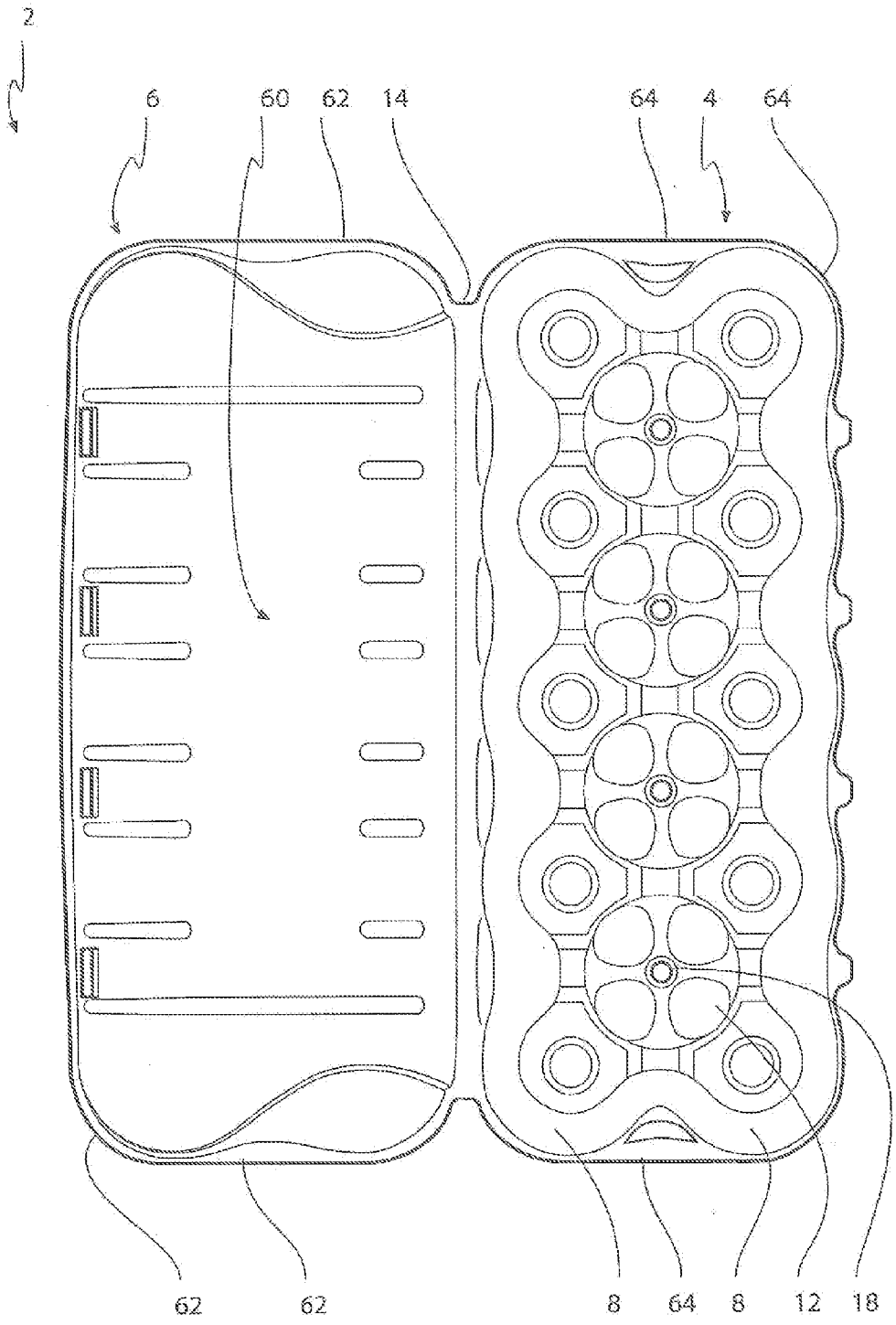
FIG. 10 shows an embodiment of an egg package according to the invention in its fully open position seen from above.

FIG. 10 shows the egg package 2 described above in its fully open position as seen from above. In this view the inner side 42 of the top surface 24 of the cover part 6 can be seen. It comprises a substantially flat and substantially rectangular, info area 60 onto which technical details about the eggs may be provided. Hereby it is achieved that such technical information is not directly visible from outside a closed egg package 2, and that such information therefore cannot interfere with the label 40 and brand that the producer wants to convey to the consumer.

The bottom part 4 and cover part 6 are so constructed that the inner and outer surfaces of the bottom part 4 as well as the inner surfaces and outer surfaces of the cover part 6 are complementary, so that when the egg package 2 is fully open it may be nested with other, identical egg packages 2 for shipment and/or storage.

Preferably, the egg package 2 is moulded as one piece. This allows for a simple and efficient way of providing the above mentioned hinge 14 connecting the bottom part 4 and the cover part 6, namely by a weakening in the moulded material of the egg package 2.

The egg package 2 is preferably made of moulded pulp, although other materials of suitable resilience and strength could be used.

The cover part 6 also comprises a rim portion 62 extending outward from the cover part 6. The rim portion 62 of the cover part 6 will ease the so-called de-nesting, because it may function as a "gripping area" for a de-nesting machine.

Advantageously, the bottom part 4 also comprises a rim portion 64 extending outward from the bottom part 4.

The egg package 2 described above and illustrated in the figures is made for accommodating 10 eggs. However it is understood that it is within the scope of the invention to provide egg packages 2 that are made for accommodating 4, 6, 8 or 12 eggs arranged in two parallel rows, or an even larger number of eggs, for example 15 eggs arranged three rows.

LIST OF REFERENCE NUMBERS

In the following is given a list of reference numbers that are used in the detailed description of the invention.

2 egg package,
4 bottom part,
5 division line,
6 cover part,
8 egg-receiving compartments,
10 non-planar side surface of egg-receiving compartments,
12 upwardly extending projections located between the rows of egg-receiving compartments,
14 hinge between bottom part and cover part,
16 front surface of the cover part,
17 back surface of cover part,
18 top of the upwardly extending projections 12,
20, 22 end surfaces of cover part,
24 top surface of cover part,
26, 28 longitudinal recesses in cover part
30 apertures in the front surface of the cover part,
32 edged frame around the apertures,
34, 36 sections of an end surface of the cover part,
38 embossment,
40 label,
42 inner side of top surface of cover part,
44 retainment projections of bottom part,
46 retainment flaps,
50 back side of bottom part,
52 front side of bottom part,
54 inwardly projecting frame part,
56 upper frame,
58 lower part of front surface of cover part,
60 info area on inner side of front surface of cover part,
62 rim of cover part, and
64 rim of bottom part.

The invention claimed is:

1. An egg package formed of a fibrous material, the egg package comprising:

a bottom part comprising a plurality of egg-receiving compartments having non-planar side surfaces so as to match at least partially the outer contours of an egg, the plurality of compartments being arranged in at least two parallel rows, a cover part comprising a top surface, a front surface, a back surface, and two end surfaces, the front surfaces having apertures which have a bottom edge and a top edge the cover part being connected to the bottom part by a hinge between the back surface and the bottom part so as to allow the cover part to move between an open position and a closed position, the bottom part comprising a back side, a front side and, two end sides, the front side having a generally horizontal upper edge, at least one retainment projection having a forwardly and downwardly extending flap for locking engagement with a cooperating aperture in the front surface of the cover part, the top surface and the front surface of the cover part forming an obtuse angle relative to each other and wherein the transition between the top surface and front surface is formed as a rounded transition region in such a way that there is a gradual transition between the top surface and front surface, the bottom edge of each of the one or more apertures projecting inwardly, the retainment flap extending upwardly no further than the upper edge of the cooperating aperture when the cover part is in its closed position, the cover part comprising a plurality of longitudinal recesses extending between the top surface and the front surface of the cover part through the rounded transition region between the top surface and front surface, and each said longitudinal recesses extending all the way from the top surface down beyond the middle of the front surface, each said longitudinal recess terminating adjacent to one or two of the co-operating apertures, such that each of the co-operating apertures is placed between two longitudinal recesses.

2. An egg package according to claim 1, wherein the cooperating apertures are framed by opposed side edges along with said top edge and said bottem edge.

3. An egg package according to claim 1, wherein a lower portion of the front surface of the cover part bulges inwardly.

4. An egg package according to claim 1, wherein the bottom part and cover part are so constructed that the inner and outer surfaces of the bottom part as well as the inner surfaces and outer surfaces of the cover part are complementary, so that when the egg package is fully open it may be nested with other, identical egg packages for shipment and/or storage.

5. An egg package according to claim 1, wherein the top surface and the back surface of the cover part form an obtuse angle relative to each other and wherein the transition between the top surface and back surface is formed as a rounded transition region in such a way that there is a gradual transition between the top surface and back surface.

6. An egg package according to claim 1, wherein the top and front surfaces of the cover part are provided with a label that at least covers the longitudinal recesses and the apertures in the front surface of the covered part.

7. An egg package as set forth in claim 1, comprising at least one upwardly extending projection located between the rows of compartments.

* * * * *